United States Patent [19]

Ginn et al.

[11] 4,077,567

[45] Mar. 7, 1978

[54] PNEUMATIC TEMPERATURE RESET DIFFERENTIAL PRESSURE CONTROLLER

[75] Inventors: LeRoy Dry Ginn; LeRoyce Sloe Ginn, both of San Leandro; Dalny Travaglio, Kensington, all of Calif.

[73] Assignee: Universal Pneumatic Controls, Inc., Oakland, Calif.

[21] Appl. No.: 697,360

[22] Filed: Jun. 18, 1976

[51] Int. Cl.[2] ..... F24F 7/06

[52] U.S. Cl. ..... 236/49; 137/468; 236/80 R

[58] Field of Search ..... 236/49, 80 R, 80 B; 137/468

[56] References Cited

U.S. PATENT DOCUMENTS

| | | | |
|---|---|---|---|
| 3,806,027 | 4/1974 | Ginn et al. | 236/49 |
| 3,809,314 | 5/1974 | Engelke et al. | 236/49 |
| 3,934,795 | 1/1976 | Ginn et al. | 236/80 B X |
| 3,941,310 | 3/1976 | Travaglio et al. | 236/49 |
| 3,955,595 | 5/1976 | Modes | 236/49 X |
| 3,961,748 | 6/1976 | McNabney | 236/49 |
| 3,994,434 | 11/1976 | Boyer et al. | 236/49 |

*Primary Examiner*—William E. Wayner

*Assistant Examiner*—William E. Tapolcai, Jr.

*Attorney, Agent, or Firm*—Owen, Wickersham & Erickson

[57] ABSTRACT

An air flow velocity controller in a variable air volume control system interlocks a room temperature signal from a thermostat with the velocity set point so that the velocity controller maintains a constantly regulated amount of air into a room in proportion to the room's thermostat demands and independent of variations in the static pressure in the duct.

The controller includes a maximum lift cam and a movable spring fulcrum which are both mounted in a common cam housing to permit the maximum velocity setting to be adjusted for varying room requirements while maintaining a constant spring range regardless of the maximum velocity setting.

The controller is constructed to provide automatic compensation for control offset produced by changes in the static air pressure in the duct.

The controller includes the ability to control the air flow at a minimum velocity so that the air can be economically reheated or a minimum volume of air flow can be maintained for ventilation requirements.

21 Claims, 14 Drawing Figures

PNEUMATIC TEMPERATURE RESET DIFFERENTIAL PRESSURE CONTROLLER

BACKGROUND OF THE INVENTION

This invention relates to a conditioned air distribution system and in particular to a velocity controller for controlling the volume flow of conditioned air in a variable air volume control system.

A conventional air distribution system that has been often used in the air conditioning industry is a constant volume air conditioning system in which a velocity controller maintains a constant velocity of discharge air from the outlet of a duct. In the constant volume system the velocity controller is on line all of the time. The controller both limits the maximum velocity and also maintains a constant velocity of discharge air.

In this constant volume type of system the primary concern is the control of air flow velocity at one setting, and the temperature regulation is obtained by mixing hot air with cold air to obtain the desired air temperature at the discharge of the duct.

In this kind of system any zone in a building measures the same amount of discharge air, whether heating or cooling, and the amount of the discharge air is the amount which the constant velocity controller is set for.

Under many conditions of operation the constant volume air conditioning system can be wasteful of energy. For example, in many cases, the full amount of the discharged air volume may not be needed for heating or cooling. And the required mixing of hot air and cold air can also be inefficient in many instances.

Because of recent pressures to economize and to conserve energy for ecology reasons, the air conditioning industry has become quite interested in variable air volume systems.

In variable air volume systems the concern is the control of velocity from a minimum (or no air flow) to a maximum amount of air flow, and the amount of air flow is varied in relation to the heating or cooling requirements of the room.

For example, assuming that the room is being cooled by cold air from the duct, as the temperature in the room goes up (as indicated by a room thermostat signal), a greater amount (volume) of cold air is discharged from the duct to cool the room back to the desired temperature; and as the room temperature goes down, a lesser amount (volume) of cold air is discharged from the duct to permit the room temperature to rise back to the desired level.

In this variable air volume system the amount of air is regulated in response to room requirements; and under most conditions of operation, there is no mixing of hot air with cold air to provide variations in the temperature of the air discharged from the duct — as is the case in constant air volume systems.

The variable air volume systems are therefore inherently more energy efficient than constant air volume systems.

Some prior art variable air volume systems have used a flow controller in which the room thermostat controlled, or positioned, the actuator for the flow control valve in the duct until the air flow velocity in the duct exceeded the setting on a velocity controller. In such a system the velocity controller only acted as a limiter, and was basically a manual adjustment for a set point. Thus, any time the thermostat is positioning the actuator and the air flow through the duct is less than that set at the maximum velocity limit (as set by the velocity controller) there is no control of the flow velocity of the air flowing through the duct. This system works satisfactorily if the static pressure does not vary. But if the static pressure of the air flow in the duct does vary (that is, if the static pressure of the duct increases or decreases with no change in the room temperature or the position of the flow control valve in the duct), the volume of air discharged from the duct decreases or increases with that static change.

In practice, static air pressure changes in the order of one inch water column to six inch water column can occur as a result of the varying air flow in system when other parts of the system are being opened or closed.

Thus, the room temperature could change in response to static pressure in the duct and did not change solely in response to changes in the room load. With a change in static air pressure in the duct, but no change in the room air temperature, the prior art system could therefore flow a different amount of cold air through the duct until the thermostat repositioned the actuator and the flow control valve in the duct; and this was an unstable loop.

A more desirable control system is one in which the room thermostat works in conjunction with the velocity controller to maintain a constantly regulated amount of air into the room in proportion to the room thermostat's demands, and independently of variations in the static pressure in the duct. In this system, if the static pressure in the duct increases (with a resultant increase in velocity pressure) the velocity controller senses the change and cuts back and regulates the air flow velocity in the duct to the same velocity as it was before the increase in the static pressure. The same is true if the static air pressure decreases. The air flow velocity controller then senses the decrease in velocity and repositions the actuator to maintain the correct velocity.

This more desirable system requires that the velocity controller be reset by the room thermostat, and it is a primary object of the present invention to interlock the room temperature (as indicated by a thermostat signal) with the velocity set point of a velocity controller in a variable air volume control system so that the velocity controller maintains a constantly regulated amount of air into a room in proportion to the room thermostat's demands and independently of variations of static pressure in the duct.

Another problem that is presented in variable air volume systems is the problem of control offset when operating at very low static pressures (very low velocity pressures). A full time velocity controller must necessarily operate during some conditions of operation with low velocity pressures in the duct. And the problems that are presented in controlling air flow at low velocity pressures are quite different from the control parameters that are presented in a velocity controller which is used only as a limiting device for limiting the maximum velocity. In a limiting device which limits the maximum velocity, the velocity controller is always working with very high static pressures; and control offset is an insignificant factor at high velocity pressures.

In a full time velocity controller which is reset by a thermostat, as noted above, as the minimum setting or zero velocity setting is approached, any change in static pressure in the duct (with the resultant offset in the set point of the controller) greatly affects the velocity of the air in the duct.

Thus, even though the velocity controller is constructed to interlock the room thermostat with the velocity controller to provide a set relationship independent of static pressure in the duct (and to maintain a certain velocity for any demand in the room thermostat), as the air flow velocity approaches zero the change of static pressure and resultant offset of the controller can make the controller ineffective to provide the required air flow demanded by the room load at low air flow rates in the duct.

It is therefore another important object of the present invention to automatically compensate for control offset caused by changes in static pressure at low air flows in the duct.

SUMMARY OF THE PRESENT INVENTION

The variable air volume control system of the present invention incorporates a velocity controller which senses air flow velocity through the duct and which is reset by changes in the room air temperature.

The velocity controller provides full time on-line control of the air flow velocity in the variable air volume system, rather than just limiting the maximum velocity of the air flow through the duct.

The controller includes a bias spring for determining the set point for controlling the air flow velocity through the duct.

The room temperature signal from a thermostat is interlocked with the bias spring to reset the velocity set point with changes in the room thermostat signal.

The interlock between the room temperature signal and the velocity set point enables the velocity controller to maintain a constantly regulated amount of air into a room in proportion to the room thermostat's demands and independently of variations of static pressure in the duct.

The control is thus a master-submaster type of control in which the thermostat is the master and the velocity controller is the submaster and is reset by the thermostat. The output of the thermostat (master) resets the set point of the velocity controller (submaster).

The velocity controller is a full time controller, not just a maximum flow limiter, and the amount of air flow through the duct is controlled from zero flow to maximum flow in response to the thermostat's signal.

In a specific embodiment of the present invention the spring force is provided by a leaf spring which exerts a spring bias force on a sensing diaphragm which senses the difference between the total pressure and the static pressure and thus the air flow velocity in the duct.

The biasing force applied to the sensing diaphragm by the leaf spring is determined by a movable reset arm. The reset arm acts as a lever on the leaf spring. One end of the reset arm is pivotally connected to the housing of the velocity controller, an intermediate portion of the reset arm is connected to the leaf spring, and the other end of the reset arm is connected to a reset piston which is movable in response to changes in the thermostat signal as indicated by a control pressure acting on the piston. When the end of the reset arm associated with the thermostat reset piston is raised, the force exerted on the leaf spring by the intermediate portion of the reset arm that is connected to the leaf spring increases to require a greater pressure differential across the sensing diaphragm and thus a greater volume of air flow through the duct.

In a specific embodiment the controller also includes a reset leaf spring. The reset leaf spring has one end engaged with the reset piston of the thermostat, and a movable fulcrum is slidably engaged with this reset spring to provide an infinite number of spring force starting points and spring ranges exerted against the reset piston.

A maximum lift cam is engageable with the reset piston to provide a maximum velocity setting for the controller, and the position of this maximum lift cam can be shifted with respect to the reset piston so that the controller can be set for different maximum flows, as required for different zones in a building.

It is an important feature of the present invention that the movable spring fulcrum and the maximum lift cam are both mounted in a common cam housing to permit the maximum velocity setting to be adjusted for varying room requirements while maintaining a constant spring range for movement of the reset piston regardless of the maximum velocity setting. By changing the spring rate with each change in the maximum flow of velocity stop, it is possible to start with minimum flow in every case with a given pressure signal from the thermostat (say eight psi) and to go to a maximum air flow volume in each case with a second given thermostat pressure signal (say 13 psi). As the maximum lift of the reset spring is changed, the spring rate is also changed to thereby maintain a constant spring range.

In a specific embodiment of the present invention the velocity controller also includes an adjustable minimum flow velocity mechanism for providing a regulated minimum amount of air to the room, regardless of whether the thermostat is calling for any air or not.

The minimum flow velocity regulating mechanism includes a minimum velocity arm which is positioned beneath the reset arm. One end of the minimum velocity arm is supported by a minimum velocity cam, the position of which is adjustable to adjust the minimum flow velocity to the desired set point.

The minimum velocity cam is also suspended by a spring suspension to prevent damage to the instrument by an attempted improper setting of the maximum flow velocity lower than the minimum flow velocity.

In a specific embodiment of the present invention, control offset (which is created by the sensitivity of the controller compared with the spring range of control) is automatically compensated, and the compensation is done simultaneously with the change in static pressure producing the offset.

In this embodiment of the present invention the velocity pressure is sensed across a sensing diaphragm which is exposed to the total pressure on one side and to the static pressure on the other side so that the difference in pressures across the sensing diaphragm is the velocity pressure.

In this embodiment the velocity controller also includes an isolation diaphragm and a seal diaphragm. The isolation diaphragm is exposed on one side to the total pressure and is exposed on the other side to atmospheric pressure. The seal diaphragm is exposed on one side to the static pressure and on the other side to the atmospheric pressure.

The present invention increases the effective area of the seal diaphragm against which the static pressure acts in relation to the effective area of the isolation diaphragm against which the total pressure acts in the amount required to provide compensation for the depression of the velocity pressure (and resulting offset of the control) with increases in static pressure. The area of the isolation diaphragm piston is made enough smaller than the area of the seal diaphragm piston that a change in static pressure (say from one inch to six inches) lowers the control point (say 5/100ths inch) and the result is a stable control.

Variable air volume system apparatus and methods which incorporate the structures and techniques described above and which are effective to function as described above constitute further, specific objects of this invention.

Other and further objects of the present invention will be apparent from the following description and claims and are illustrated in the accompanying drawings which, by way of illustration, show preferred embodiments of the present invention and the principles thereof and what are now considered to be the best modes contemplated for applying these principles. Other embodiments of the invention embodying the same or equivalent principles may be used and structural changes may be made as desired by those skilled in the art without departing from the present invention and the purview of the appended claims.

BRIEF DESCRIPTION OF THE DRAWINGS

FIG. 8 shows the relative positions of the parts when the reset pressure from the thermostat is low. This provides less control spring load and allows the velocity pressure ($P_T$ - $P_S$) to drive the actuator in the duct in a direction to close the flow valve to reduce the amount of cold air flowing past the flow control valve and into the room with the thermostat.

FIG. 10 shows the relative positions of a spring fulcrum and a maximum flow velocity limiting cam with respect to the thermostat reset piston when the movable maximum flow velocity cam has been positioned to limit the maximum flow velocity at a relatively low maximum flow velocity. In this event, the movable spring fulcrum has been positioned to provide a high spring rate on the reset spring to provide the same spring range with respect to the pressure range of the temperature reset piston as provided at all other positions of the maximum flow limit cam with respect to the temperature reset piston.

DETAILED DESCRIPTION OF THE PREFERRED EMBODIMENTS

Figure 1:
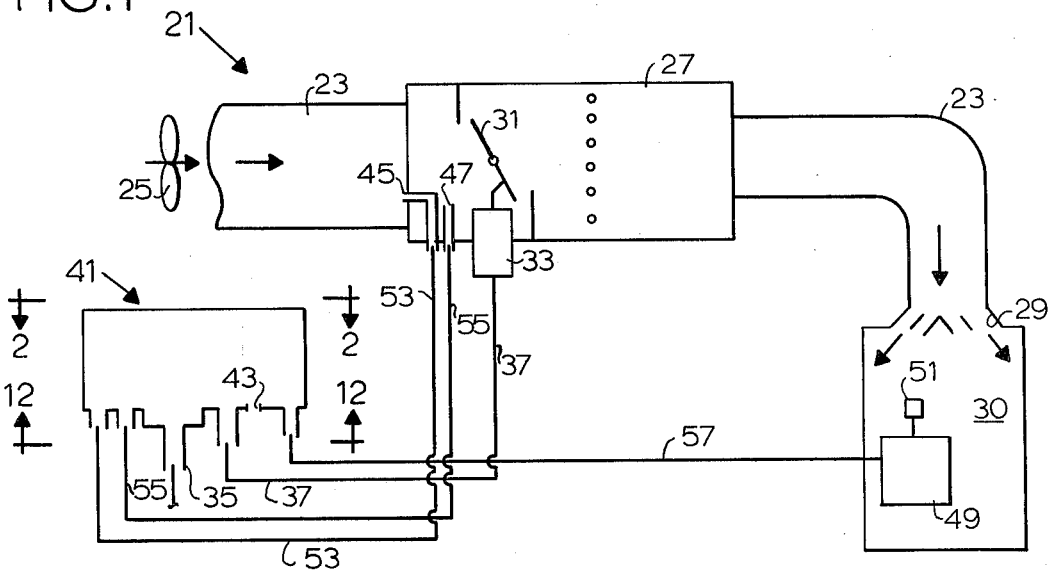
FIG. 1 is a side elevation view of a variable air volume conditioned air distribution system incorporating a temperature reset differential pressure controller constructed in accordance with one embodiment of the present invention.

A variable air volume control system constructed in accordance with one embodiment of the present invention is indicated generally by the reference numeral 21 in FIG. 1.

The system 21 comprises a duct 23, a fan 25, a regulator box 27 in the cut 23, and outlets 29 for conducting air from the duct 23 to a room 30.

In most installations the complete system 21 will include a number of branch ducts 23 with related regulator boxes 27 for supplying conditioned air to different zones of a building, but only a single branch duct and regulator box and related room or zone are shown in FIG. 1 in order to simplify the description of operation.

The volume of air flow through the regulator box 27 is controlled by a valve 31, and the valve 31 is moved in opening and closing directions by an air powered actuator 33.

In a specific embodiment of the present invention (as illustrated in FIG. 1) pneumatic air from a conduit 35 is used to power the actuator 33.

In accordance with the present invention a temperature reset differential pressure controller 41 controls the amount of air pressure transmitted from the air inlet line 35 (and through the outlet line 37 to the actuator 33) by controlled venting of the air pressure through a vent port 43.

The pressure in the actuator 33 is regulated by the controller 41 in response to air flow velocity in the duct 23 and in response to room air temperature in the room 30.

The air flow velocity may be sensed by a total pressure pick up probe 45 and a static air pressure pick up probe 47, as illustrated, or the air flow velocity may be sensed by any other suitable air flow velocity sensing means.

The room air temperature in the room 30 is sensed by a thermostat 49 (having an adjustment knob 51 for setting the set point of the thermostat).

The total pressure pick up probe 45 is connected to the controller 41 by a line 53, and the static pressure pick up probe 47 is connected to the controller 41 by a line 55.

The thermostat 49, in a specific embodiment of the present invention, is a direct acting thermostat which produces an output signal, typically in a five psi range, on a line 57 which connects the thermostat 49 to the controller 41.

In a specific embodiment of the present invention the thermostat produces a signal of eight psi when a thermostat demands a minimum air flow and produces a signal of thirteen psi when the thermostat 49 demands a maximum air flow.

Figure 4:
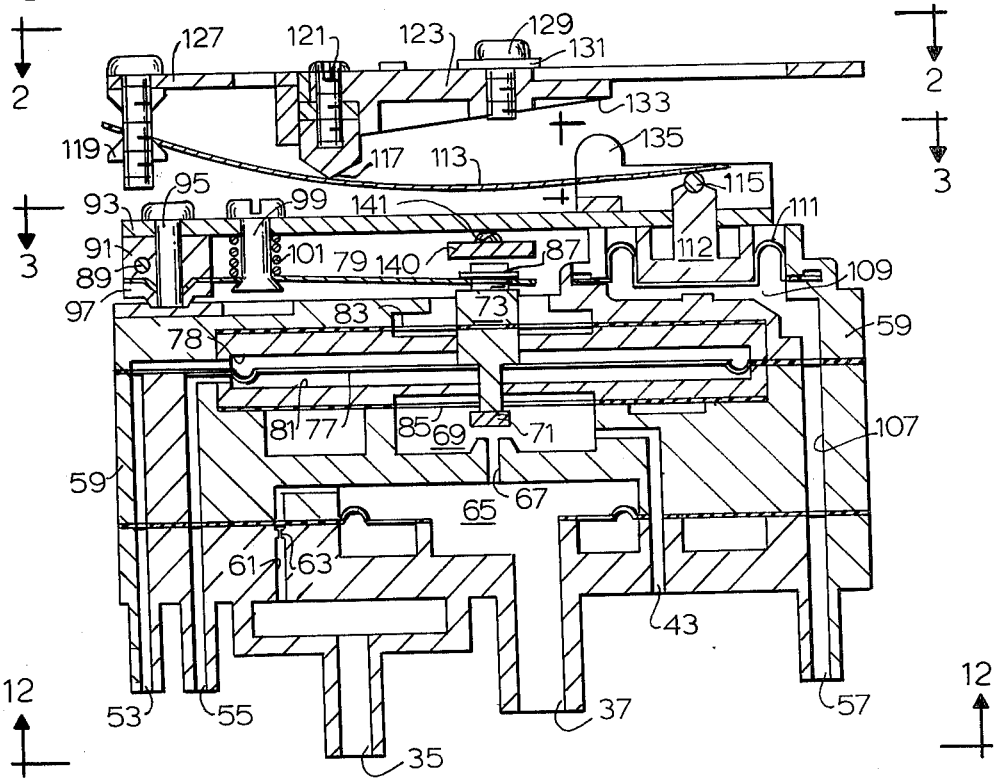
FIG. 4 is a side elevation view in cross section through the controller and taken along the line and in the direction indicated by the arrows 4—4 in FIG. 3.

As best illustrated in FIG. 4, the controller 41 comprises a housing 59 which, for convenience of manufacture and assembly, is actually made up of several different sections.

As illustrated in FIG. 4, air from the pneumatic air inlet 35 flows through a passageway 61 having a restrictor 63 and into a chamber 65.

The chamber 65 is directly connected to the outlet 37 to the actuator 33.

The chamber 65 is also connected, through an orifice 67, to a chamber 69; and the chamber 69 is connected to atmosphere through the vent 43.

Flow through the orifice 67 and into the chamber 69 is controlled by a valve 71.

The valve 71 is mounted at the lower end of an arbor 73.

The arbor 73 is movable vertically up and down (as viewed in FIG. 4) within a bore 75 in the housing 59 under the control of forces exerted on the arbor by a sensing diaphragm 77 and a bias leaf spring 79.

The sensing diaphragm 77 has a central part which is attached to the arbor 75, and the sensing diaphragm is exposed to the total pressure of the duct (from a chamber 78 above the diaphragm 77) and is exposed to the static pressure in the duct (from a chamber 81 on the lower surface of the sensing diaphragm 77).

An isolation diaphragm 83 isolates the total pressure in chamber 78 from the atmospheric pressure above the isolation diaphragm 83.

A seal diaphragm 85 seals the static pressure in the chamber 81 from atmospheric pressure in the chamber 69.

The difference between the duct air total pressure in 78 and the duct air static pressure in chamber 81 is the velocity pressure, and the sensing diaphragm 77 thus senses the air flow velocity of the air in the duct 23 and transmits a force to the arbor 73 which is in direct proportion to the air flow velocity in the duct.

Thus, as the air flow velocity increases in the duct, the sensing diaphragm 77 exerts a greater downward force on the arbor 75. This tends to move the valve 71 toward a position which restricts the flow of air from the orifice 67 and thus increases the pressure in the actuator 33 (by allowing less of the pneumatic air pressure in chamber 65 to be vented to atmosphere). This causes the actuator 33 to move the valve 31 toward a more closed position to reduce the air flow velocity in the duct 23.

The bias leaf spring 79 exerts a force on the arbor 73 in an upward direction, opposing the force exerted on the arbor 73 by the sensing diaphragm 77.

One end of the bias leaf spring 79 is connected to the arbor by a retaining ring 87.

The other end of the bias leaf spring 79 is connected to a pivotal assembly which includes a pivot pin 89 (attached to the housing 59), a leaf spring mount 91, an end of a reset arm 93, a pivot bolt 95 and a pivot nut 97.

The pivot nut 97, pivot bolt 95 and leaf spring mount 91 fasten the bias leaf spring 79 to the reset arm 93 in a fixed position with respect to the reset arm.

The entire assembly pivots on the pivot pin 89 so that, when the reset arm 93 is raised, the upward biasing force exerted by the bias leaf spring 79 on the arbor 73 is increased.

Figure 6:
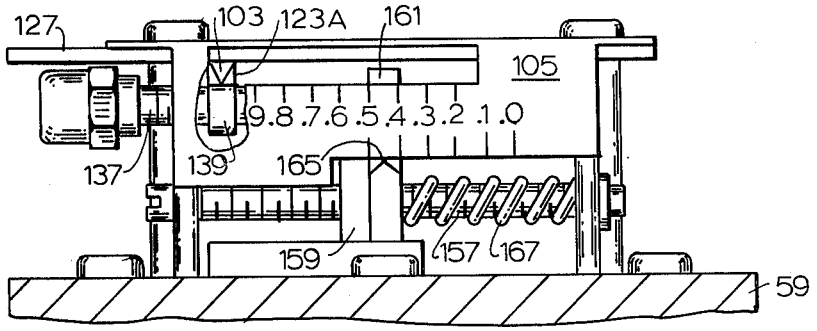
FIG. 6 is a side elevation view taken along the line and in the direction indicated by the arrows 6—6 in FIG. 3.

To provide a calibration capability, a calibration adjust screw 99 with a calibration spring 101 is provided to adjust the relationship of the bias leaf spring 79 to the reset arm 93 and to an associated pointer 103 on a scale 105 (see FIG. 6).

The maximum velocity pointer 103 is connected to an arm 123A of a housing 123 (to be described) and is calibrated with respect to the scale 105 by adjusting the calibration screw 99 (see FIG. 4). This calibration screw 99 is adjusted until the indicated velocity and the controlled velocity are the same.

It is an important feature of the present invention that the room temperature signal from the thermostat 49 is interlocked with the velocity set point of the differential pressure controller 41.

In the present invention the room temperature signal from the thermostat resets the velocity set point by the apparatus and method which will now be described.

The room thermostat control pressure from the line 57 is ducted through a thermostat air passageway 107 to a reset chamber 109 formed by a reset diaphragm 111 on the top and the control housing 41 on the bottom.

A reset piston 112 rests on top of the reset diaphragm 111. The upper end of the reset piston 112 is attached to the end of the reset arm 93 so that as the reset piston 112 moves up and down (as viewed in FIG. 4) the reset arm 93 is swung upwardly and downwardly about the pivot pin 89.

The connection of the upper end of the reset piston 112 to the reset arm 93 is shown as a multiport assembly in FIG. 4, but this assembly can be made as a single integral part.

When the room thermostat 49 control pressure is increased in the reset chamber 109, the reset diaphragm 111 acts against the reset piston 112 causing the piston to rise as the pressure in the reset chamber 109 increases.

As the right hand end of the reset arm 93 is raised, resulting upward movement of the reset 93 about the pivot 89 increases the biasing force exerted by the bias leaf spring 79 on the arbor 73, raising the velocity set point of the controller 41.

Figure 8:
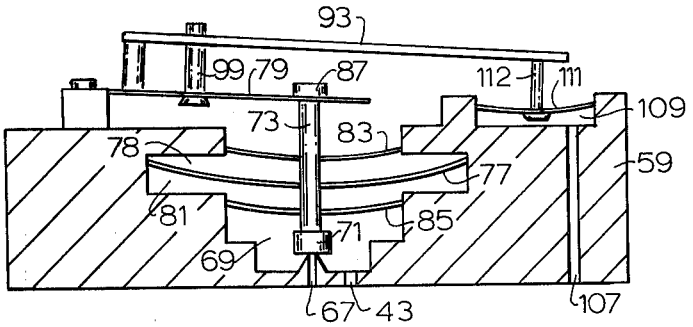
FIG. 8 is a side elevation view in cross section like FIG. 4 but somewhat simplified to illustrate the action of the temperature reset piston on the differential pressure controller.

FIG. 8 shows the relative disposition of the parts of the controller when the thermostat is calling for less cooling air into the room 30. In this case, there is a low reset pressure in the chamber 109 by the thermostat signal because the room air temperature is below the set point of the thermostat. The reset arm 93 is therefore permitted to tilt downward at the right hand end, and this reduces the spring load exerted on the arbor 73 by the bias leaf spring 79. The velocity pressure sensed across the sensing diaphragm 77 acts to move the arbor 73 and valve 71 downward to a position in which the valve 71 restricts or completely blocks off the flow of air through the orifice 67. This increases the pressure in the actuator 33 and moves the flow valve 31 toward a more closed position decreasing the flow of cooling air through the duct 23 to the room 30.

Figure 9:
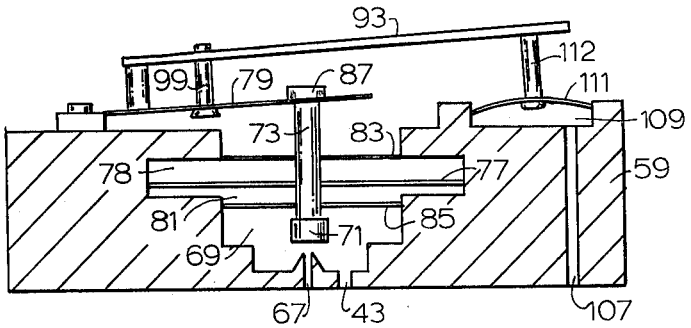
FIG. 9 is a view like FIG. 8 but shows the relative positions of the parts when the thermostat produces a high reset pressure. This forces more control spring load for counteracting the velocity pressure and drives the actuator in a direction to open the flow control valve in the duct to let more cold air into the room with the thermostat.

FIG. 9 is a view like FIG. 8 but shows the action of the components when the thermostat pressure signal in the chamber 109 calls for more cooling air flow into the room 30. In this event, the reset piston 112 moves the reset arm 93 upward to increase the force exerted by the bias leaf spring 79 on the arbor 73 and to move the valve element 71 further off the orifice 67. This permits more of the pressurized air to be vented from the actuator 33 to move the flow valve 31 toward a more open position.

A reset spring 113 resists the upward movement of the reset piston 112 by exerting a downward force on a reset pin 115.

As illustrated in FIG. 4, the reset spring 113 is a leaf spring which is engaged by a fulcrum 117 in a mid-portion of the spring.

The reset spring 113 is a pre-bent spring with an arc normally extending upward (as viewed in FIG. 4), but the fulcrum 117 deflects the spring to a near flat position over its range.

The end of the leaf spring 113 opposite that engaged with the reset pin 115 is secured to an adustable spring retainer 119.

The spring fulcrum 117 is adjustable, in an upward and downward direction as viewed in FIG. 4, by a fulcrum adjustment screw 121. The screw 121 (by its vertical positioning of the fulcrum) provides the starting point of the reset action of the spring.

The fulcrum 117 and its adjustment 121 are mounted in the fulcrum housing 123. The fulcrum housing 123 is in turn mounted in a slot 125 of a back plate 127. The fulcrum housing 123 is slidable (from left-to-right as viewed in FIG. 4) to change the point of the fulcrum's contact with the reset spring 113.

Figure 2:
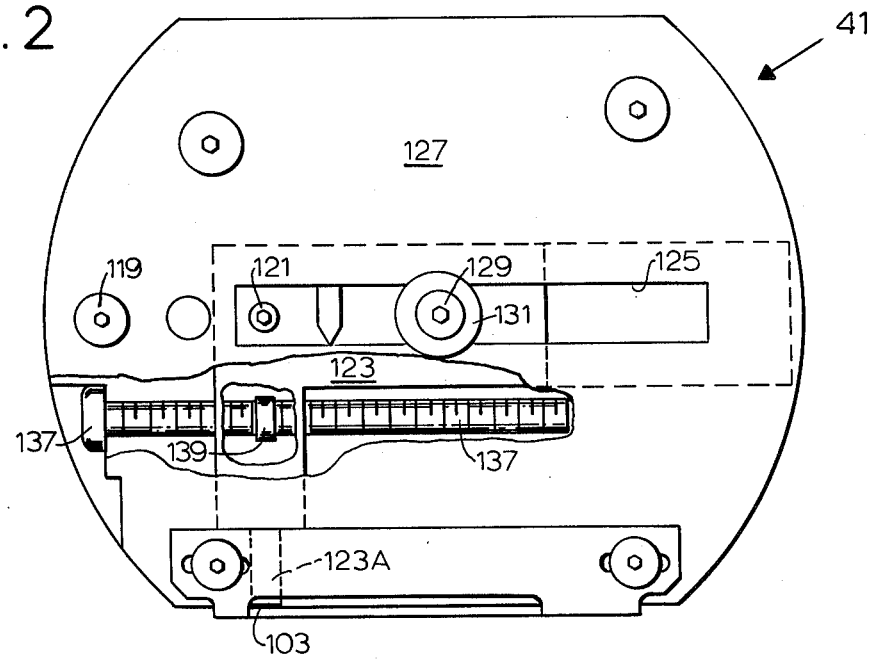
FIG. 2 is a top plan view of the controller incorporated in the system shown in FIG. 1 and is taken along the line and in the direction indicated by the arrows 2—2 in FIG. 1 and in FIG. 4.
Figure 3:
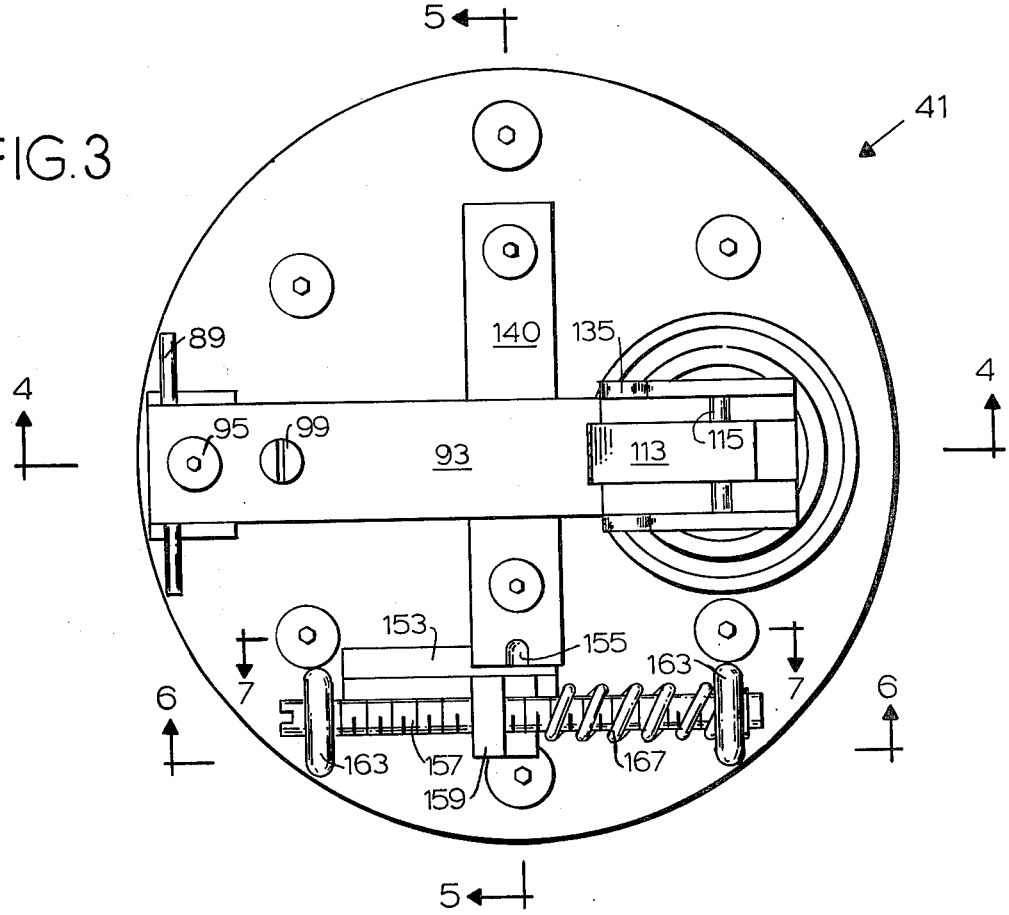
FIG. 3 is a top plan view of a portion of the controller and is taken along the stepped line and in the direction indicated by the arrows 3—3 in FIG. 4.

As best illustrated in FIG. 2, the fulcrum housing 123 is slidably adjustable in the guideway 125 by a maximum velocity screw 137 and a maximum velocity nut 139. The nut 139 is connected to the housing 123 so that, as the screw 137 is rotated within the back plate 127, the housing 123 is moved to the left or to the right as viewed in FIG. 2, depending upon the direction of rotation of the screw 137.

A clamping screw 129 and washer 131 (see also FIG. 2) retain the fulcrum housing 129 in an adjusted position in the guideway slot 125.

The ability to change the point of contact of the fulcrum 117 with the reset spring 113, and also the ability to change the amount of pressure exerted at that contact give an infinite number of spring force starting points and spring ranges exerted against the reset pin 115.

The standard spring range for controlled devices is 5 psi. That is, the standard spring ranges for valves and actuators come in a 3 to 8 psi range, a 5 to 10 psi range and an 8 to 13 psi range.

It is therefore desirable to maintain this five psi range for the velocity controller from a no flow condition to a maximum flow condition, and the variable starting point and starting pressure of the fulcrum described above provides the capability for meeting these conditions.

As a result, the control system of the present invention can use a standard thermostat and can sequence a valve with the standard thermostat.

The structure so far described thus provides for interlocking the room temperature signal from a thermostat with the velocity set point to cause the temperature to reset the velocity set point. The temperature reset of the velocity set point can be initiated with an infinite number of starting points and can be carried out with an infinite number of spring ranges because of the two adjustments provided by the slide 125 and the screw 121 for the fulcrum 117.

The controller of the present invention also provides for a maximum velocity setting and a minimum velocity setting.

The maximum velocity setting is provided by a maximum lift cam 133 formed on the bottom of the cam housing 123 and by a reset lift stop 135 located near the right hand end of the reset arm 93 (as viewed in FIG. 4).

As the reset piston 112 is moved upward by increasing thermostat pressure in the chamber 109, the reset lift stop 135 engages the maximum lift cam 133 at a given value of the thermostat signal output. The level of the output signal at which contact occurs depends upon the position of the fulcrum housing 123, and the resulting positioning of the maximum lift cam with respect to the reset lift stop 133 and the resulting spring rate of the reset spring 113. When the stop 135 engages the cam 133, it limits the maximum upward movement of the reset piston 112 and the lift of the reset arm 93.

Because the maximum lift cam 133 and the spring fulcrum 117 are both mounted in the cam housing 123, and because the cam and fulcrum are therefore both moved together by the maximum velocity screw 137 and the maximum veocity nut 139 (see FIGS. 2 and 6), as the lift of the spring is changed, the spring rate of the reset spring 113 is also changed to thereby maintain a constant spring range.

Figure 11:
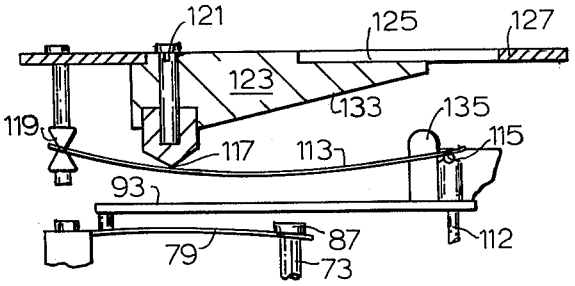
FIG. 11 is a view like FIG. 10 and shows how the movable spring fulcrum has been positioned to provide a low spring rate for maintaining a constant spring range when the maximum flow velocity limit cam has been positioned to allow a relatively high maximum air flow velocity.
Figure 12:
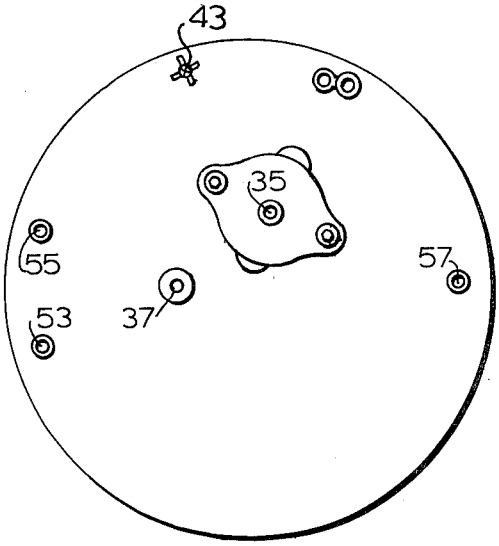
FIG. 12 is a bottom plan view of the controller and is taken along the line and in the direction indicated by the arrows 12—12 in FIG. 1 and in FIG. 4.
Figure 13:
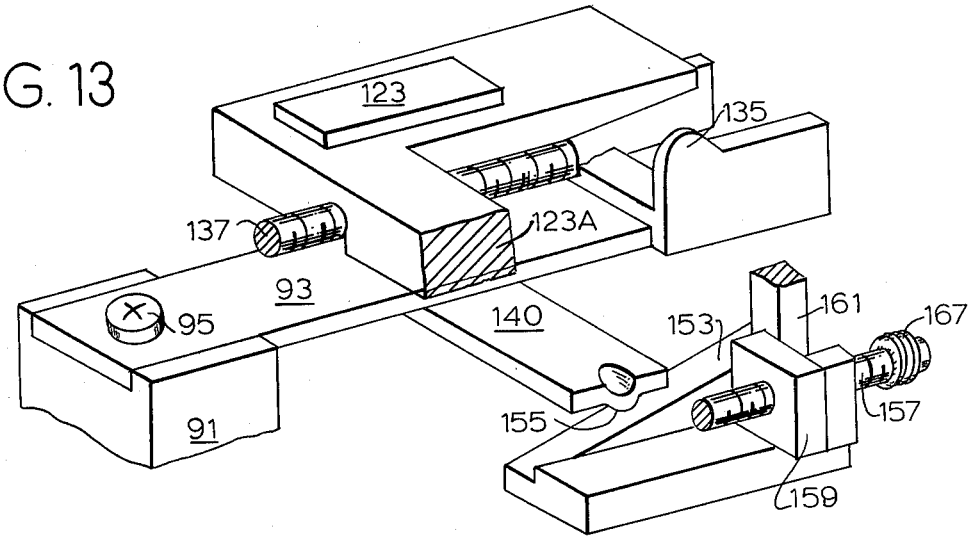
FIG. 13 is an isometric view showing the relationship of the reset arm to the maximum air flow velocity cam and to the minimum flow velocity arm and cam.

For example, and as best illustrated, in FIG. 11, as the cam housing 123 is moved in a leftward direction (as viewed in FIG. 11) that would permit greater lift on the reset arm 93, the fulcrum 117 moved at the same time in a direction to provide a lower spring rate on the reset spring 113.

Figure 10:
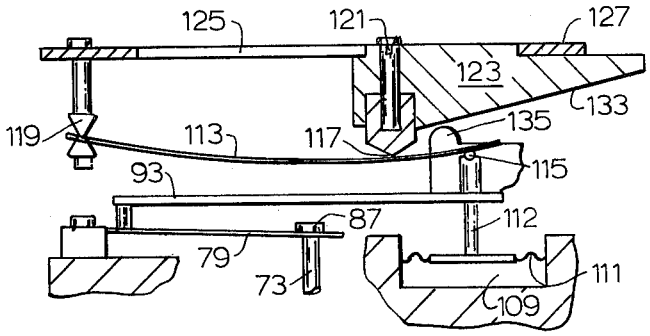
FIG. 10 is a cross sectional view like FIG. 4 but showing only a fragmentary part of FIG. 4.

Conversely, and as best illustrated in FIG. 10, when the cam housing 123 is moved in a rightward direction (as viewed in FIG. 10) to restrict the lift of the reset arm 93, the fulcrum 117 moves in the same direction to provide a higher spring rate with the reset spring 113.

This action maintains a constant spring range regardless of the maximum velocity setting.

The controller 41 thus responds to the thermostat 49 and supplies air at their required velocity, from zero flow to the maximum flow as set by the maximum lift cam 133.

In many installations there is a specification requiring that the velocity controller supply a minimum amount of air to the room, regardless of whether the thermostat is calling for any air or not.

This minimum air flow is frequently required for ventilation. Sometimes it is required to provide air over a reheat coil.

The controller of the present invention incorporates a minimum velocity setting which will now be described.

The position of the reset arm 93 determines the velocity set point of the controller 41 as described above. To provide a minimum velocity, the travel of the reset arm 93 is limited, as it travels toward the zero velocity setting, by a minimum velocity arm 140. The minimum velocity arm 140 has a contact dimple 141 which engages the underside of the reset arm 93 to restrict the downward movement of the reset arm 93 (see FIGS. 4 and 5).

Figure 5:
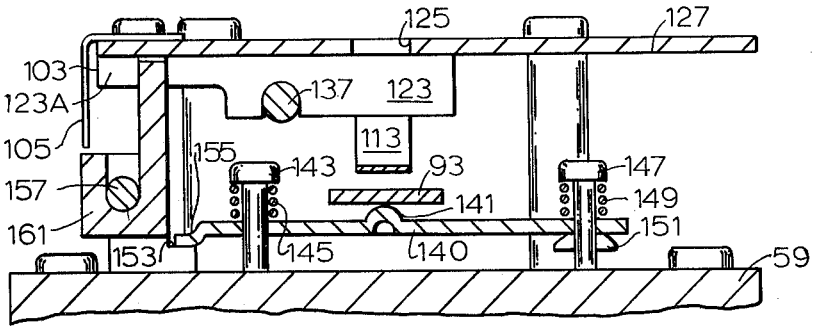
FIG. 5 is an end elevation view in cross section taken along the line and in the direction indicated by the arrows 5—5 in FIG. 3.

The minimum velocity arm 140 is positioned beneath the reset arm 93 by a screw 143 and spring 145 and by a screw 147 and a spring 149 as illustrated in FIG. 5. The springs 145 and 149 force the minimum velocity arm 140 in a downward direction.

A minimum velocity calibration nut 151 restricts the downward movement of one end of the minimum velocity arm 140.

Figure 7:
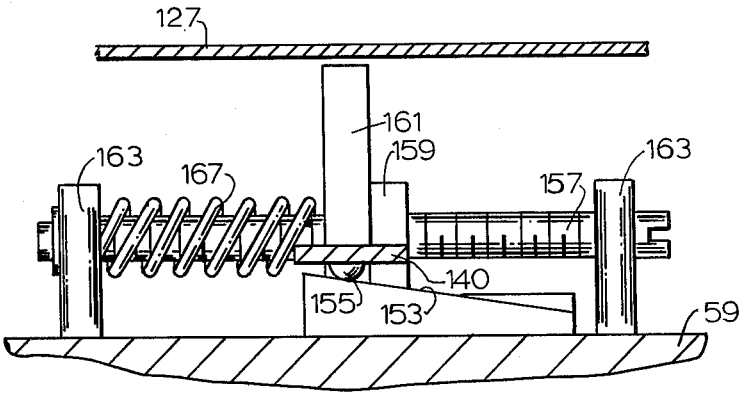
FIG. 7 is a side elevation view taken along the line and in the direction indicated by the arrows 7—7 in FIG. 3.

The opposite end of the minimum velocity arm 140 resets on a minimum velocity cam 153 (see FIG. 7).

As illustrated in FIG. 7, the underside of the minimum velocity arm 140 has a dimple 155 which engages the minimum velocity cam 153.

The minimum velocity cam 153 is adjustable to a desired position by a minimum velocity screw 157 which rotates in a drive nut 159 engaged with (but not attached to) a flange 161 which is integral with the cam 153. The ends of the screw 157 are rotatable within support flanges 163 attached to the housing 59.

As illustrated in FIG. 6, a minimum velocity setting pointer 165 on the flange 161 moves along the scale 105 as the minimum velocity screw 157 is rotated.

The minimum velocity calibration nut 151 (see FIG. 5) provides a means of interlocking the minimum velocity pointer 165 so that it reads properly on the velocity scale 105. This is accomplished by raising the minimum velocity calibration nut 151 until the indicated velocity and the controlled velocity are the same.

The combination of the minimum velocity screw 157 and the minimum velocity nut 159 drives the cam 153 to a lower position, or a lower set point when the screw 157 is turned in one direction.

When the minimum velocity screw 157 is turned in an opposite direction, the nut 159 is no longer pushing against the minimum velocity cam 153; and a return spring 167 forces the cam 153 against the minimum velocity nut 159.

This manner of positioning the minimum velocity cam 153 eliminates the danger of setting the maximum velocity setting lower than the minimum velocity setting, thereby damaging the instrument. If someone inadvertently does attempt to lower the maximum velocity setting lower than the minimum velocity setting in the controller 51 of the present invention, the maximum velocity indicator arm 123A (as shown in FIG. 6) comes on contact with the minimum velocity indicator arm 161 (as shown in FIG. 6). In this event, the only resistance to the maximum velocity indicator arm 123A meets is the pressure exerted by the return spring 167, and this prevents any damage to the instrument.

The temperature reset differential pressure controller of the present invention as described above provides full time velocity control of the air flow in the duct 23 with the thermostat interlocked with the differential pressure regulator so that the temperature resets the velocity set point.

As a result, the controller maintains a constantly regulated amount of air into the room in proportion to the room thermostat's demands and independent of variations in static pressure in the duct. That is, since the velocity controller is a full time controller (rather than acting only as a limiter on the maximum velocity), the interlock with the thermostat eliminates the variations in the flow which can be caused by changes in the duct static pressure (as can occur in variable air volume systems in which the velocity control acts only to limit the maximum amount of air).

However, variations in the static air pressure in the duct can still cause problems in obtaining proper regulation of the air flow volume as the air flow approaches minimum or zero settings. These problems arise out of the fact that there is a problem of offset which is created by the sensitivity of the differential pressure controller compared with the spring range of control; and this problem of offset (which is insignificant at high flow velocities and corresponding high velocity pressures) becomes quite large in comparison to the low velocity pressure available for control purposes when the flow velocity is reduced to minimum settings.

As noted above, a five psi control pressure difference is commonly used for valve movements between the fully open and fully closed positions. Existing instruments for actuating the valve commonly show sensitivities of 0.01 inch of water column per one psi. This gives 0.05 inches of water column for a five psi control pressure range, or $+/-0.025$ inches of water column offset from the control point.

A change in static pressure from approximately one inch to approximately six inches in the duct can therefore produce a resultant offset in the controller of 0.05 inch water column.

The present invention provides automatic compensation for the control offset caused by changes in the duct static pressure by constructing the controller so that, as the static pressure changes, the change in static pressure automatically changes the set point of the controller.

This automatic compensation is achieved by making the effective area of the isolation diaphragm enough smaller than the effective area of the seal diaphragm that the change in static pressure from one inch to six inches lowers the control point 0.05 inch water column, and the result is a stable control.

The effect of the change in the static pressure is decreased by increasing the area of the seal diaphragm against which the static pressure acts to provide compensation for the velocity pressure which has been depressed by the offset created by the sensitivity of the controller compared with the spring range of control.

Figure 14:
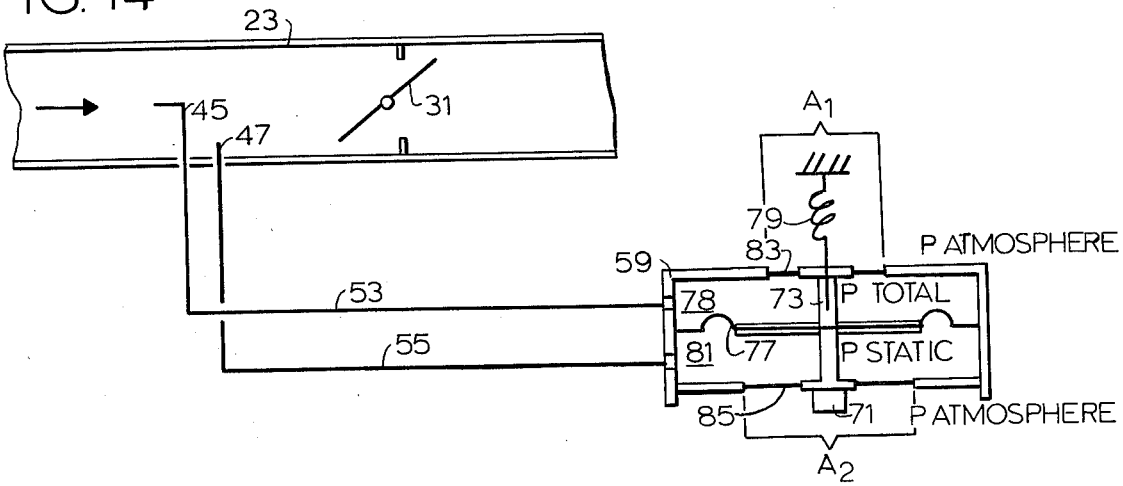
FIG. 14 is a view like FIG. 1, but shows a differential pressure controller which automatically compensates for control offset resulting from changes in duct static pressure at low air flow velocities in the duct.

This is best illustrated in FIG. 14.

As illustrated in FIG. 14, the atmospheric pressure on the outside of the isolation diaphragm 83 acts across the effective area A1 to provide a downward force on the arbor 73. The total pressure in the chamber 78 also acts on the sensing diaphragm 77 to provide an additional downward force on the arbor 73, and the static pressure in the chamber 81 acts on the effective area A2 of the seal diaphragm 85 to provide an additional downward force on the arbor 73. The total downward force acting on the arbor 73 is thus the sum of these three separate downwardly acting forces.

The upwardly directed forces acting on the arbor 73 include the total pressure in chamber 78 acting on the area A1 of the isolation diaphragm 83, the static pressure in the chamber A1 acting on the area of the sensing diaphragm 77, the atmospheric pressure acting on the effective area A2 of the seal diaphragm 85 and the spring force of the spring 79 (shown as a coil spring for simplicity of illustration in FIG. 14).

At a given room temperature demand, and with no change in the static pressure in the duct, the upward and downward forces balance one another to maintain the arbor at a fixed position.

In order to make the spring 79 accountable for velocity sensing only, the effective areas A1 and A2 of the isolation diaphragm 83 and the seal diaphragm 87 would be made equal, as has been done in U.S. Pat. No. 3,806,027 to Ginn et al and assigned to the same assignee as the present application. This construction is quite satisfactory when the velocity controller is used to limit the maximum velocity, because under such conditions the controller is dealing with high velocity pressures; and a change of static pressure of five inches water column in the duct produces only an insignificant amount of change in the velocity pressure.

However, in the present invention, the controller is a full time velocity controller which is reset by the thermostat so that, as minimum velocity settings are approached, any change in the static pressure in the duct can have (if proper and prompt compensation is not made for the static pressure change) a very significant effect on the velocity pressure. A five inch water column change in static pressure in the duct, with no change in room load demand, can become quite critical for example when the velocity pressure itself is at or near 0.038 inch water column. As pointed out above, the static pressure in the duct can vary this much, with no change in room temperature demand, when other ducts in the system are being opened and closed.

In the present invention the effective area A2 of the seal diaphragm 85 is made enough larger than the effective area A1 of the isolation diaphragm to provide automatic compensation for such variations in the static pressure in the duct.

This relationship is illustrated (in exaggerated form for clarity of illustration) in FIG. 14.

While we have illustrated and described the preferred embodiments of our invention, it is to be understood that these are capable of variation and modification, and we therefore do not wish to be limited to the precise details set forth, but desire to avail ourselves of such changes and alterations as fall within the purview of the following claims.

We claim:

1. A control for a variable air flow volume conditioned air distribution system of the kind having an air flow duct for supplying conditioned air to a room, a movable member in the duct for regulating the volume of air flowing through the duct, and an air powered actuator connected to position the movable member, said control comprising, valve means for varying the pressure of the air supplied to the actuator, air flow velocity sensing means for sensing the air flow velocity in the duct and connected to the valve means for applying a flow velocity force to the valve means in response to the sensed air flow velocity, bias spring means connected to the valve means for applying a spring force to the valve means in opposition to the flow velocity force of the air flow velocity sensing means to determine the air flow velocity set point of the controller, room temperature sensing means for sensing the temperature of the air in the room and connected to the bias spring means for applying a room temperature force to the bias spring means in response to the sensed temperature to change the air flow velocity set point of the control in response to changes in the room air temperature so that the control maintains a constantly regulated amount of air flow into the room in proportion to the room's temperature demands, and including calibration means for calibrating the air flow velocity set point of the controller.

2. A control for a variable air flow volume conditioned air distribution system of the kind having an air flow duct for supplying conditioned air to a room, a movable member in the duct for regulating the volume of air flowing through the duct, and an air powered actuator connected to position the movable member, said control comprising, valve means for varying the pressure of the air supplied to the actuator, air flow velocity sensing means for sensing the air flow velocity in the duct and connected to the valve means for applying a flow velocity force to the valve means in response to the sensed air flow velocity, bias spring means connected to the valve means for applying a spring force to the valve means in opposition to the flow velocity force of the air flow velocity sensing means to determine the air flow velocity set point of the controller, room temperature sensing means for sensing the temperature of the air in the room and connected to the bias spring means for applying a room temperature force to the bias spring means in response to the sensed temperature to change the air flow velocity set point of the control in response to changes in the room air temperature so that the control maintains a constantly regulated amount of air flow into the room in proportion to the room's temperature demands, and including a reset arm connected to the bias spring means and wherein the temperature sensing means include a reset piston connected to the reset arm.

3. The invention defined in claim 2 including reset spring means for applying an adjustable bias on the reset piston.

4. The invention defined in claim 3 wherein the reset spring means is a leaf spring and including a fulcrum engaged with the reset leaf spring and fulcrum adjustment means for adjusting both the vertical and the horizontal positions of the fulcrum with respect to the leaf spring.

5. The invention defined in claim 3 including maximum velocity cam means for limiting the maximum travel of the reset piston to limit the maximum air flow velocity in the duct.

6. The invention defined in claim 5 wherein the bias spring means includes a leaf spring and including adjustable fulcrum means for adjusting the rate of the leaf spring.

7. The invention defined in claim 6 wherein the maximum velocity cam means and the adjustable fulcrum means are interconnected for concurrently adjusting the spring rate in relation to the adjustment of the spring travel to provide a constant spring range between a zero air flow velocity and a maximum air flow velocity in the duct as regulated by the movement of the reset piston.

8. The invention defined in claim 2 including a minimum flow velocity arm for limiting the minimum flow movement of the reset arm.

9. The invention defined in claim 8 including calibration means for calibrating the minimum flow velocity setting of the controller.

10. The invention defined in claim 8 including a minimum velocity cam for positioning the minimum flow velocity arm and including adjustment means for adjusting the position of the minimum velocity cam to vary the minimum flow velocity setting of the control.

11. The invention defined in claim 10 including a spring suspension for the minimum velocity cam whereby inadvertent lowering of the maximum velocity setting lower than the minimum velocity setting merely compresses the spring suspension and prevents damage to the control.

12. A control for a variable air flow volume conditioned air distribution system of the kind having an air flow duct for supplying conditioned air to a room, a movable member in the duct for regulating the volume of air flowing through the duct, and an air powered actuator connected to position the movable member, said control comprising, valve means for varying the pressure of the air supplied to the actuator, air flow velocity sensing means for sensing the air flow velocity in the duct and connected to the valve means for applying a flow velocity force to the valve means in response to the sensed air flow velocity, bias spring means connected to the valve means for applying a spring force to the valve means in opposition to the flow velocity force of the air flow velocity sensing means to determine the air flow velocity set point of the controller, room temperature sensing means for sensing the temperature of the air in the room and connected to the bias spring means for applying a room temperature force to the bias spring means in response to the sensed temperature to change the air flow velocity set point of the control in response to changes in the room air temperature so that the control maintains a constantly regulated amount of air flow into the room in proportion to the room's temperature demands, and including offset compensating means for automatically compensating for offset of the control caused by changes of static air pressure in the duct.

13. The invention defined in claim 12 wherein changes in static air pressure in the duct change the velocity set point of the control.

14. The invention defined in claim 11 wherein the air flow velocity sensing means include a pressure sensing diaphragm, a higher air pressure chamber on one side of the sensing diaphragm, a lower air pressure chamber on the opposite side of the sensing diaphragm, an isolation diaphragm forming one wall of the higher air pressure chamber and exposed to atmospheric air pressure on the side opposite that exposed to the higher air pressure in said higher air pressure chamber, a seal diaphragm forming one wall of the lower air pressure chamber and exposed to atmospheric pressure on the side opposite that exposed to the lower air pressure in said chamber, and wherein the offset compensating means include an effective area of the seal diaphragm enough larger than the effective area of the isolation diaphragm to compensate for the offset produced by an increase in static air pressure in the duct.

15. A control for a variable air flow volume conditioned air distribution system of the kind having an air flow duct for supplying conditioned air to a room, a movable member in the duct for regulating the volume of air flowing through the duct, and an air powered actuator connected to position the movable member, said control comprising, valve means for varying the pressure of the air supplied to the actuator, air flow velocity sensing means for sensing the air flow velocity in the duct and connected to the valve means for applying a flow velocity force to the valve means in response to the sensed air flow velocity, bias spring means connected to the valve means for applying a spring force to the valve means in opposition to the flow velocity force of the air flow velocity sensing means to determine the air flow velocity set point of the controller, and offset compensating means for automatically compensating for offset of the control caused by changes of static air pressure in the duct.

16. The invention defined in claim 15 wherein changes in static air pressure in the duct change the velocity set point of the control.

17. The invention defined in claim 15 wherein the air flow velocity sensing means include a velocity pressure sensing diaphragm, a total air pressure chamber on one side of the sensing diaphragm, a static air pressure chamber on the opposite side of the sensing diaphragm, an isolation diaphragm forming one wall of the total air pressure chamber and exposed to atmospheric air pressure on the side opposite that exposed to the total air pressure in said total air pressure chamber, a seal diaphragm forming one wall of the static air pressure chamber and exposed to atmospheric pressure on the side opposite that exposed to the static air pressure in said static air pressure chamber, and wherein the offset compensating means include an effective area of the seal diaphragm enough larger than the effective area of the seal diaphragm to compensate for the offset produced by an increase in static air pressure in the duct.

18. A method of controlling the volume of air flow through a duct in a variable air flow conditioned air distribution system, said method comprising, regulating the volume of air flow through the duct by an air powered actuator, supplying air under pressure to the actuator through a supply conduit, controlling the pressure of the air supplied to the actuator by a valve associated with the supply conduit, sensing the air flow velocity in the duct and applying a flow velocity force to the valve in one direction in response to the air flow velocity, applying a bias spring force to the valve in opposition to the flow velocity force to determine the air flow velocity set point, sensing the temperature of the room supplied with the conditioned air from the duct, combining a room temperature force with the bias spring force in response to the sensed temperature to change the air flow velocity set point with changes in the room temperature, and including changing the velocity set point in response to changes in static air pressure in the duct to automatically compensate for control offset caused by changes of static air pressure in the duct.

19. A method of controlling the volume of air flow through a duct in a variable air flow conditioned air distribution system, said method comprising, regulating the volume of air flow through the duct by an air powered actuator, supplying air under pressure to the actuator through a supply conduit, controlling the pressure of the air supplied to the actuator by a valve associated with the supply conduit, sensing the air flow velocity in the duct and applying a flow velocity force to the valve in response to the air flow velocity, applying a bias spring force to the valve in opposition to the flow velocity force to determine the air flow velocity set point, and changing the velocity set point in response to changes in static air pressure in the duct to automatically compensate for control offset caused by changes in static air pressure in the duct.

20. A method of compensating for offset of a fluid flow regulating control mechanism caused by a change in one of the pressures sensed by the control mechanism, said method comprising, positioning a control element of the control mechanism to regulate the volume of fluid flow through a duct, sensing first and second pressures of the fluid flowing in the duct and applying a first flow velocity force to the control element in response to the difference between said pressures, applying a bias spring force to the control element in opposition to the first flow velocity force to determine the fluid flow velocity set point of the control mechanism, and changing the velocity set point in response to changes in one of the sensed pressures to automatically compensate for control offset caused by changes in that sensed pressure.

21. A flow control mechanism which compensates for offset of the control mechanism caused by a change in one of the pressures sensed by the control, said control mechanism comprising, a control element for regulating the volume flow of a fluid flowing through a duct, sensing means for sensing first and second pressures of the fluid flowing in the duct and operatively associated with the control element to apply a first flow velocity force to the control element in response to the difference between said pressures, bias spring means connected to the control element for applying a spring force to the control element in opposition to the flow velocity force to determine the fluid flow velocity set point of the control mechanism, and offset compensating means for automatically compensating for offset of the control mechanism caused by changes in one of the pressures sensed by the sensing means.

* * * * *

UNITED STATES PATENT OFFICE

CERTIFICATE OF CORRECTION

Patent No. 4,077,567 Dated March 7, 1978

Inventor(s) Le Roy Dry Ginn et al.

It is certified that error appears in the above-identified patent and that said Letters Patent are hereby corrected as shown below:

Column 6, line 36, "cut" should read -- duct --.

Column 10, line 29, "veocity" should read -- velocity --.

Column 10, line 36, after "117" insert -- is --.

Signed and Sealed this

*Twenty-second* Day of *August 1978*

[SEAL]

*Attest:*

RUTH C. MASON
*Attesting Officer*

DONALD W. BANNER
*Commissioner of Patents and Trademarks*